US010297952B2

(12) United States Patent
Zhao

(10) Patent No.: US 10,297,952 B2
(45) Date of Patent: May 21, 2019

(54) ELECTRICAL CONNECTOR HAVING AN IMPROVED GROOVE

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/823,416

(22) Filed: Nov. 27, 2017

(65) Prior Publication Data

US 2018/0151983 A1 May 31, 2018

(30) Foreign Application Priority Data

Nov. 25, 2016 (CN) ..... 2016 1 1058930

(51) Int. Cl.

| | |
|---|---|
| ***H01R 13/64*** | (2006.01) |
| ***H01R 12/57*** | (2011.01) |
| ***H01R 13/26*** | (2006.01) |
| ***H01R 13/627*** | (2006.01) |
| ***H01R 13/652*** | (2006.01) |
| ***H01R 13/66*** | (2006.01) |
| ***H01R 24/60*** | (2011.01) |
| ***H01R 13/504*** | (2006.01) |

(Continued)

(52) U.S. Cl.

CPC ..... *H01R 13/64* (2013.01); *H01R 12/57* (2013.01); *H01R 13/26* (2013.01); *H01R 13/504* (2013.01); *H01R 13/627* (2013.01); *H01R 13/652* (2013.01); *H01R 13/6585* (2013.01); *H01R 13/6658* (2013.01); *H01R 24/60* (2013.01); *H01R 13/5045* (2013.01); *H01R 13/6594* (2013.01); *H01R 2107/00* (2013.01)

(58) Field of Classification Search

CPC ..... H01R 13/64; H01R 13/26; H01R 13/627; H01R 13/652; H01R 13/6658; H01R 12/57

USPC ..... 439/607.01

See application file for complete search history.

(56) References Cited

U.S. PATENT DOCUMENTS 8,684,769 B2 * 4/2014 Kao ..... H01R 13/6471 439/607.28
9,214,766 B1 * 12/2015 Yu ..... H01R 13/6585

(Continued)

FOREIGN PATENT DOCUMENTS

| | | |
|---|---|---|
| CN | 105470697 | 4/2016 |
| CN | 105703144 A | 6/2016 |

*Primary Examiner* — Tulsidas C Patel
*Assistant Examiner* — Peter G Leigh
(74) *Attorney, Agent, or Firm* — Wei Te Chung; Ming Chieh Chang

(57) ABSTRACT

An electrical connector includes a contact module, a shielding shell enclosing the contact module and an insulative shell insert-molded with the shielding shell. The contact module includes an insulative housing having a first insulator and a second insulator assembled to the first insulator, and a shielding plate sandwiched between the first insulator and the second insulator. One of two surfaces of the first insulator and the second insulator resisting the shielding plate and two surfaces of the shielding plate resisted against by the first insulator and the second insulator includes a groove recessed to receive insulative materials along a transverse direction.

18 Claims, 15 Drawing Sheets

(51) Int. Cl.

| | |
|---|---|
| ***H01R 13/6585*** | (2011.01) |
| *H01R 13/6594* | (2011.01) |
| *H01R 107/00* | (2006.01) |

(56) References Cited

U.S. PATENT DOCUMENTS 9,425,560 B1 * 8/2016 Su ..... H01R 13/6591
9,525,251 B2 * 12/2016 Yen ..... H01R 24/60
9,954,303 B2 * 4/2018 Guo ..... H01R 12/722
2014/0206233 A1 * 7/2014 Kao ..... H01R 13/6471
439/607.28
2015/0171573 A1 * 6/2015 Little ..... H01R 24/60
439/607.34
2015/0194770 A1 * 7/2015 Little ..... H01R 13/6582
439/607.27
2015/0207280 A1 * 7/2015 Little ..... H01R 24/60
439/607.34
2015/0222059 A1 * 8/2015 Little ..... H01R 13/6587
439/607.55
2015/0244110 A1 * 8/2015 Ju ..... H01R 13/6585
439/607.01
2015/0244111 A1 * 8/2015 Ju ..... H01R 13/6585
439/607.05
2015/0244118 A1 * 8/2015 Lin ..... H01R 24/60
439/357
2016/0064870 A1 * 3/2016 Yu ..... H01R 24/60
439/607.05
2016/0079713 A1 * 3/2016 Yu ..... H01R 13/6582
439/607.27
2016/0093974 A1 * 3/2016 Lai ..... H01R 13/5202
439/736
2016/0104972 A1 * 4/2016 Feng ..... H01R 13/6581
439/607.27
2016/0111821 A1 * 4/2016 Lan ..... H01R 13/646
439/607.01
2016/0149338 A1 * 5/2016 Xing ..... H01R 13/5845
439/449
2016/0294108 A1 * 10/2016 Tsai ..... H01R 13/5219

* cited by examiner

ELECTRICAL CONNECTOR HAVING AN IMPROVED GROOVE

BACKGROUND OF THE DISCLOSURE

1. Field of the Disclosure

The present disclosure relates to an electrical connector, and more particularly to an electrical connector adapted for normally and reversely mating.

2. Description of Related Arts

China Patent No. CN105403144 discloses an electrical connector comprising a module and an insulative shell. The module comprises an insulative housing, two rows of contacts affixed to the insulative housing, a shielding plate affixed to the insulative housing, and a shielding shell enclosing the insulative housing. The insulative housing includes a base portion, a tongue portion extending forwardly from the base portion, and an extending portion extending rearward from the base portion. The shielding shell includes a rear portion enclosing an upper surface of the extending portion. The rear portion includes a sealing hole. The extending portion includes a sealing groove communicating with the sealing hole. The shielding plate includes an opening communicating with the sealinghole. In the process of forming the insulative housing, the insulative materials are integrated with the sealing hole, the opening, and the sealing groove. The insulative housing, the shielding shell, and the shielding plate include respective grooves for filling the insulative materials. However, the sealing hole, the opening, and the sealing groove are located at the top-to-bottom direction and the size is too small to have a good effect of waterproof.

China Patent No. CN105470697 discloses an electrical connector including an insulative housing, a number of contacts accommodated in the insulative housing, a metal shell attached to the housing and defining a receiving space, and a waterproof portion formed behind the receiving space. The insulative housing includes a groove, a tongue portion located in front of the groove, and a holding potion located behind the groove. The holding portion has a dispensing port communicating with the groove and an exterior. Each contact has a contacting section exposed on the tongue portion, a connecting section exposed from the groove, a holding section accommodated in the holding portion of the insulative housing, and a soldering section extending from the holding portion. The waterproof portion is received in the groove.

SUMMARY OF THE DISCLOSURE

Accordingly, an object of the present disclosure is to provide an electrical connector ensuring a good waterproof effect.

To achieve the above object, an electrical connector comprises: a contact module, a shielding shell enclosing the electrical connector and an insulative shell integrated with the shielding shell. The contact module comprises an insulative housing including a first insulator and a second insulator assembled in a vertical direction and a shielding plate sandwiched between the first insulator and the second insulator. One of an upper surface and a lower surface of the shielding plate comprises a groove receiving the insulative materials along a transverse direction perpendicular to the vertical direction.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
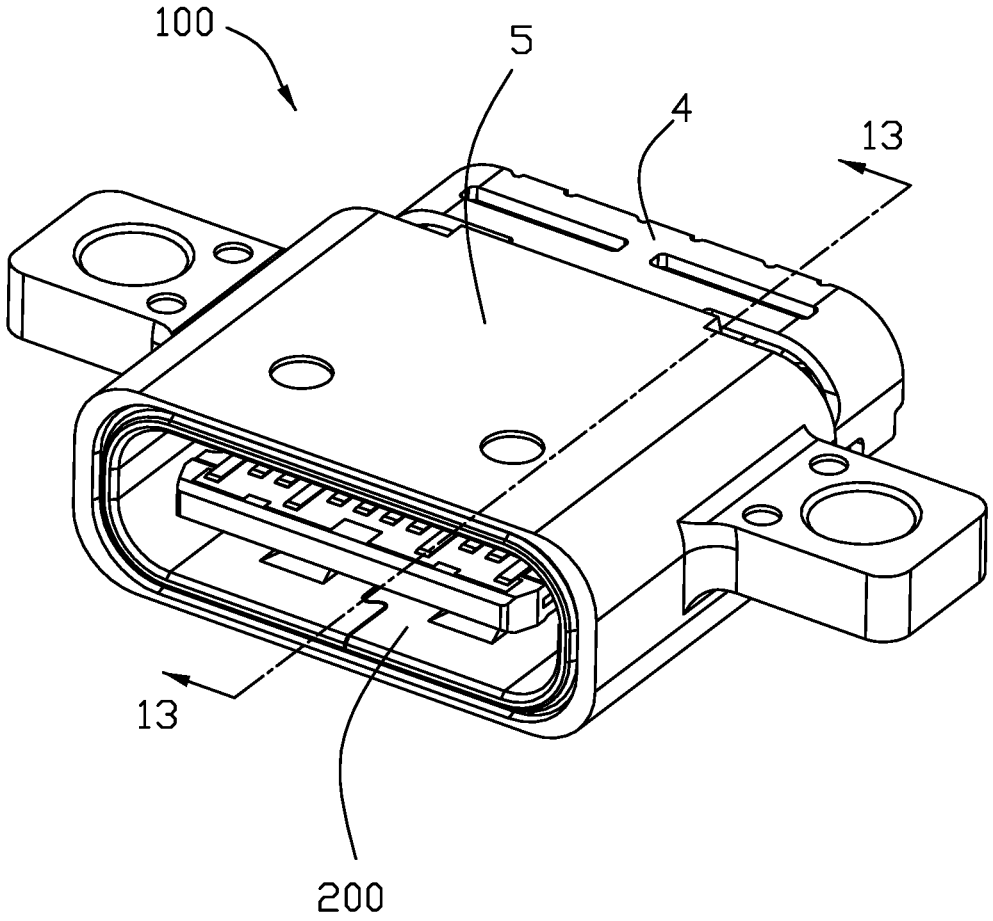
FIG. 1 is a perspective, assembled view of an electrical connector.
Figure 2:
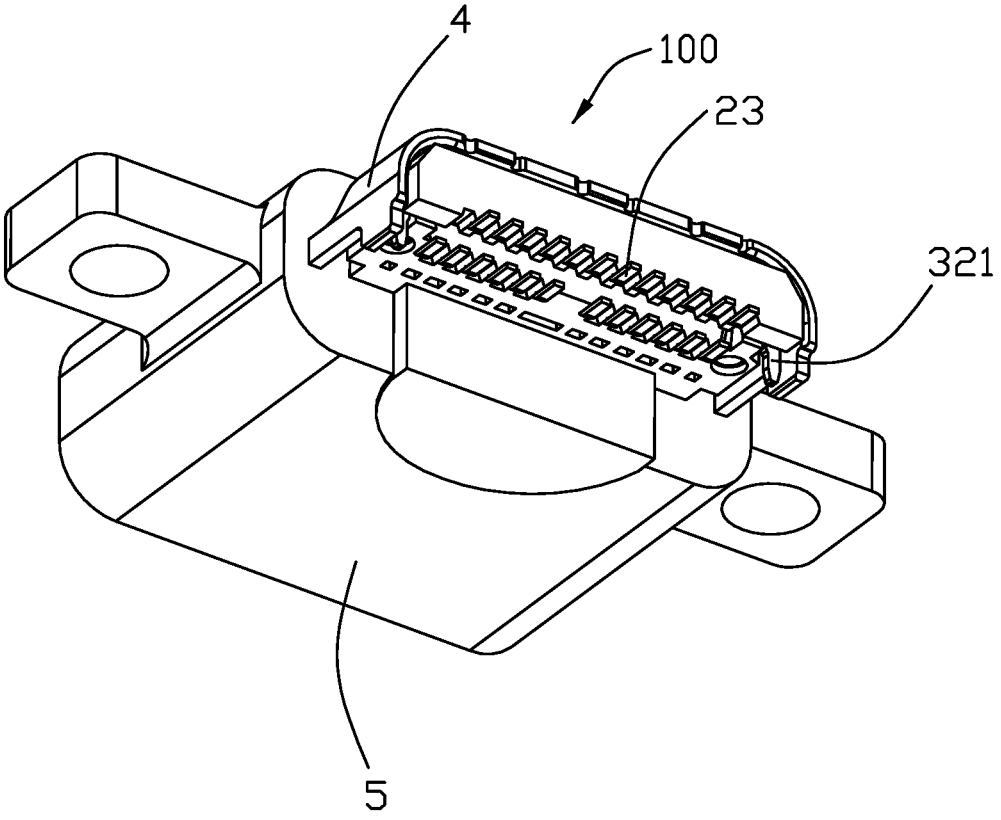
FIG. 2 is another assembled view of the electrical connector taken from FIG. 1.
Figure 3:
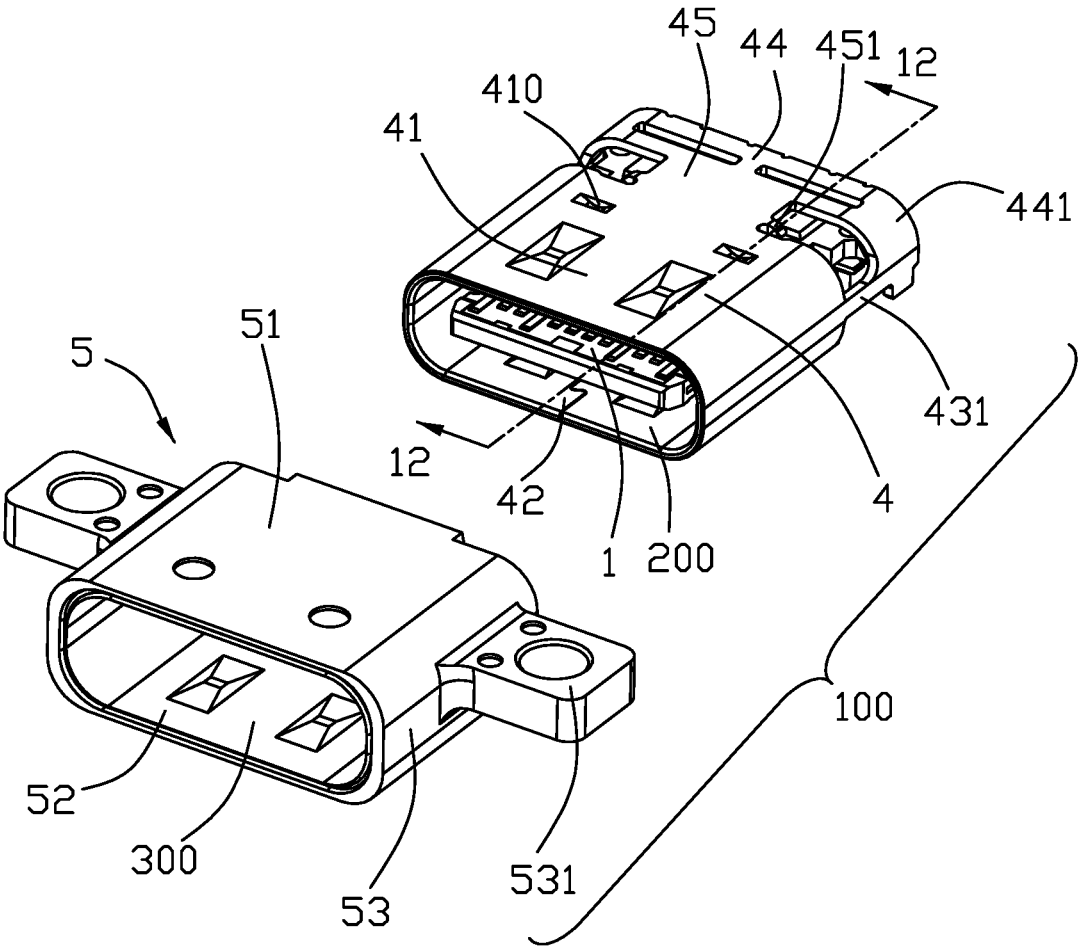
FIG. 3 is a partial exploded view of the electrical connector.
Figure 4:
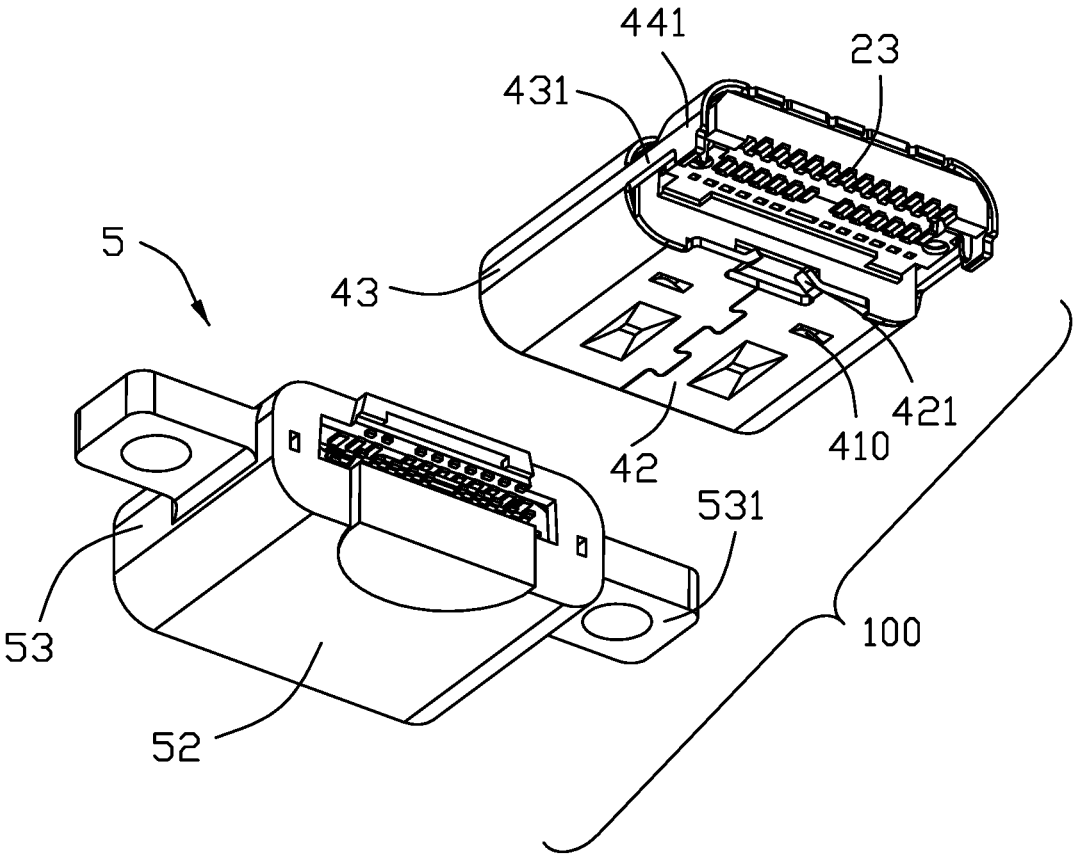
FIG. 4 is another partial exploded view of the electrical connector taken from FIG. 3.
Figure 5:
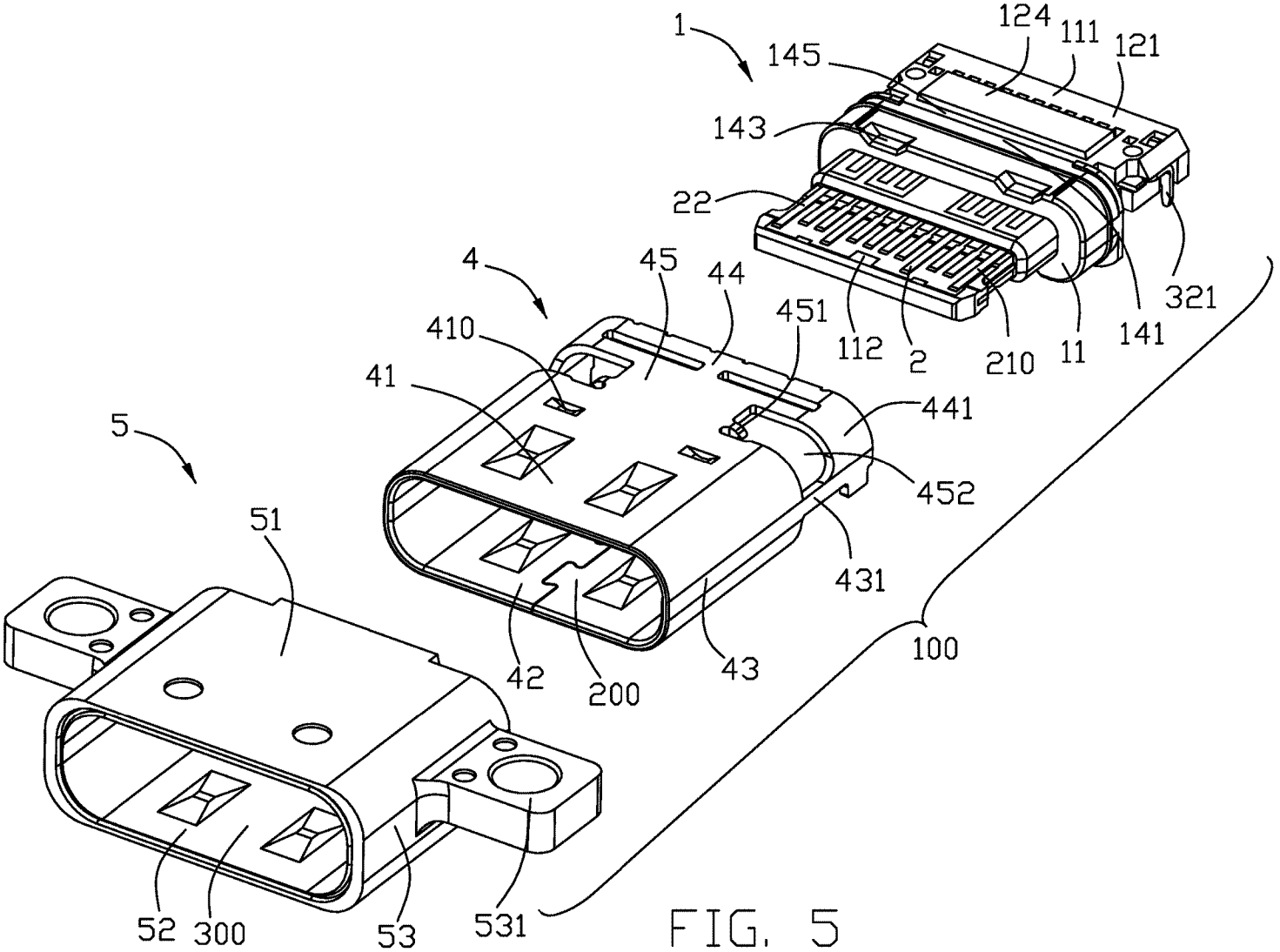
FIG. 5 is a further exploded view of the electrical connector taken from FIG. 3.
Figure 6:
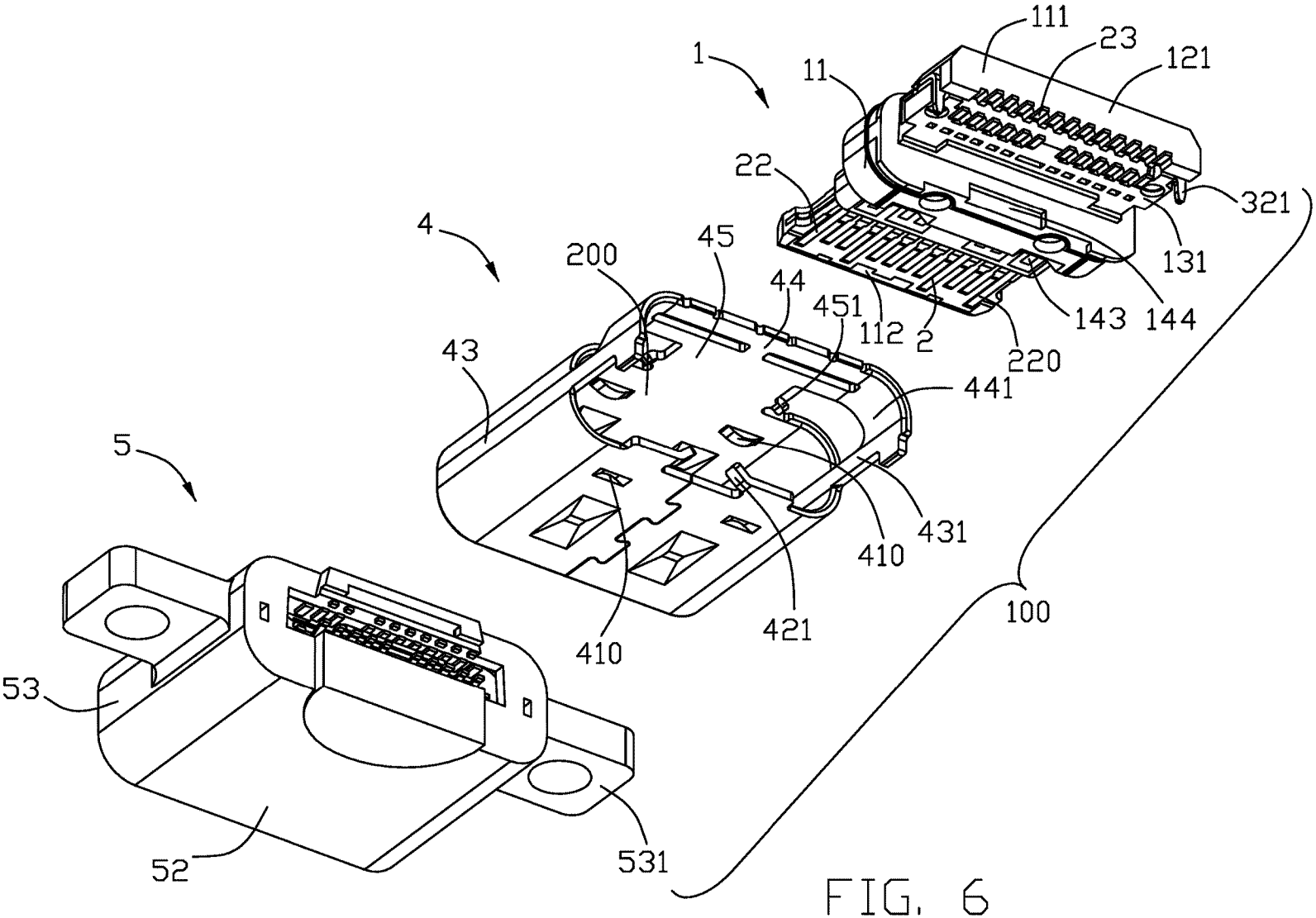
FIG. 6 is another further exploded view of the electrical connector taken from FIG. 5.
Figure 7:
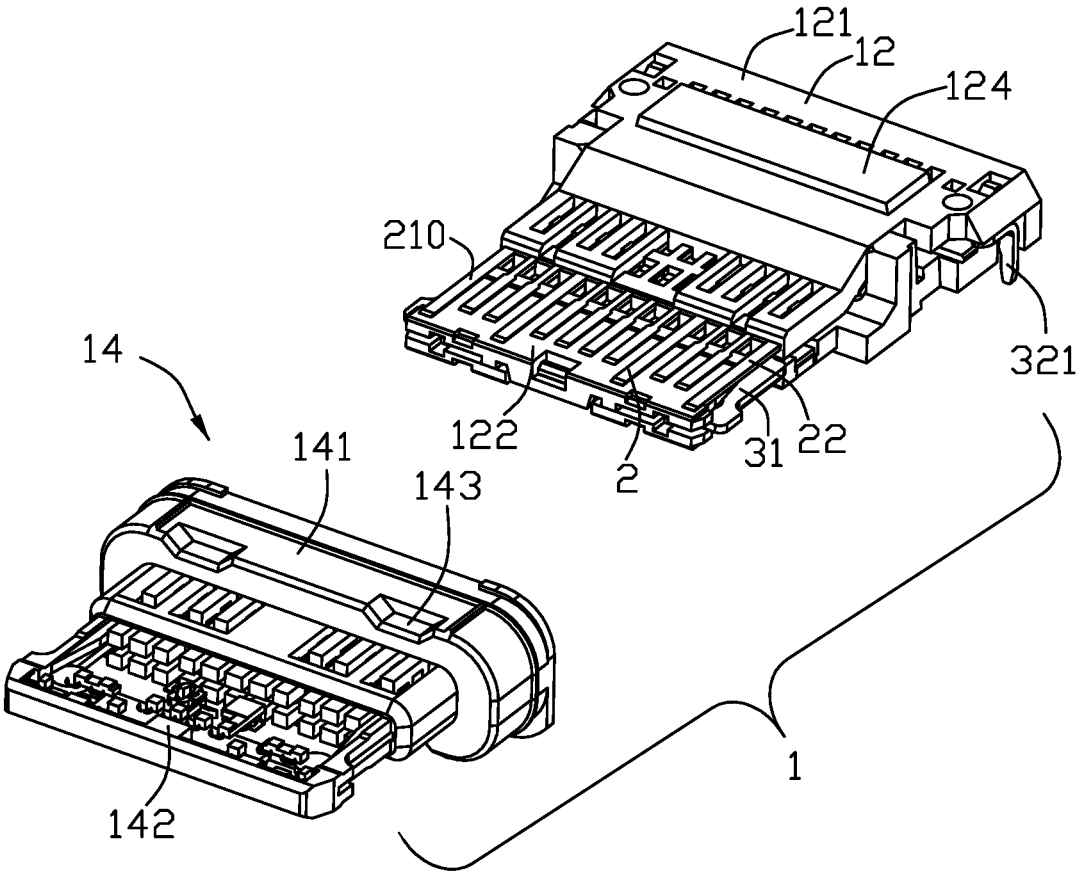
FIG. 7 is a partial exploded view of a contact module of the electrical connector in a first embodiment.
Figure 8:
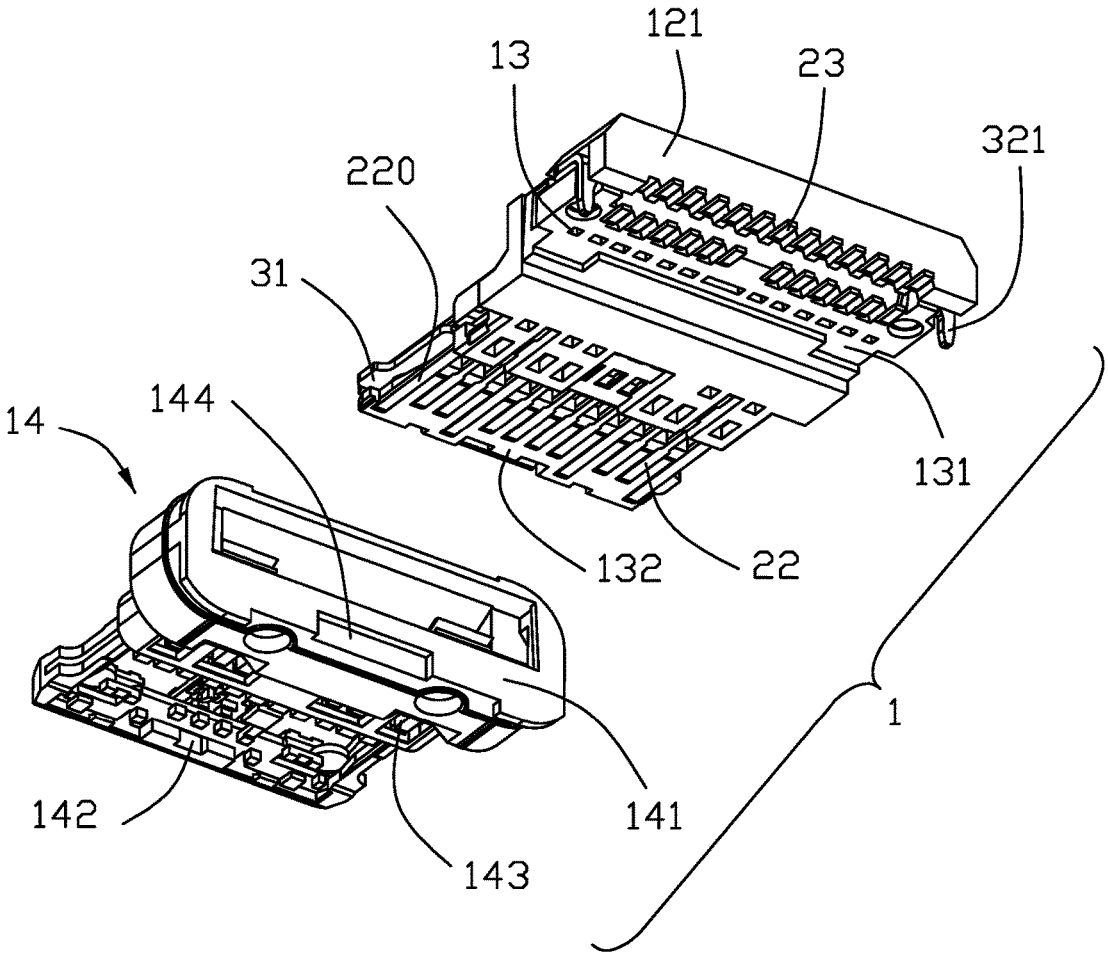
FIG. 8 is another partial exploded view taken from FIG. 7.

Reference will now be made in detail to the embodiments of the present disclosure. A first embodiment is shown in FIGS. 1 to 13. The electrical connector 100 includes a contact module 1, a shielding shell 4 enclosing the contact module 1, and an insulative shell 5 integrated with the shielding shell 4. The contact module 1 includes an insulative housing 11, a plurality of conductive terminals 2 affixed to the insulative housing 11, and a shielding plate 3 affixed to the insulative housing 11.

The insulative housing 11 includes a base portion 111 and a tongue portion 112 extending forwardly from the base portion 111. The insulative housing 11 includes a first insulator 12, a second insulator 13 assembled to the first insulator 12, and a third insulator 14. The first insulator 12 includes a first base portion 121 and a first tongue portion 122 extending forwardly from the first base portion 121. The first base portion 121 includes a pair of first locking portions located laterally, a protruding portion 124 located at an upper surface thereof, and a first groove 125 recessed upwardly from a bottom surface thereof for receiving insulative materials along a transverse direction. The first groove 125 has a through hole (not labeled) communicating a left surface and a right surface thereof. The first groove 125 includes a pair of first guiding opening 1251 located laterally. The first tongue portion 122 includes a buckling hole 126 in the front thereof. The second insulator 13 includes a second base portion 131 and a second tongue portion 132 extending forwardly from the second base portion 131. The second base portion 131 includes a pair of second locking portions 133 extending upwardly from the lateral sides of the second base portion, and a second groove 134 recessed on the upper surface thereof for receiving insulative materials along the transverse direction. The second groove 134 has a through hole (not labeled) communicating a left surface and a right surface thereof. The second groove 134 includes a pair of second guiding openings 1341 located laterally. The second tongue portion 132 includes a buckling tuber 135 in the front thereof. The third insulator 14 includes a third base portion 141 and a third tongue portion 142 extending forwardly from the third base portion 141. The third base portion 141 includes a plurality of resisting recesses 143 recessed in an upper surface and bottom surface of the front thereof, and a buckling groove 144 recessed in the bottom surface in the rear end thereof. The first base portion 121, the second base portion 131 and the third base portion 141 form the base portion 111. The first tongue portion 122, the second tongue portion 132 and the third tongue portion 142 form the tongue portion 112.

Referring to FIGS. 9 to 12, each conductive terminal 2 includes a fixed portion 21, a contacting portion 22 extending forwardly from the fixed portion 21, and a soldering portion 23 extending rearward from the fixed portion 21. The conductive terminals 2 include a plurality of upper terminals 210 and a plurality of lower terminals 220. Each contacting portion 22 of the upper terminals 210 is positioned in reverse symmetry with respect to a respective one of the lower terminals 220.

Figure 9:
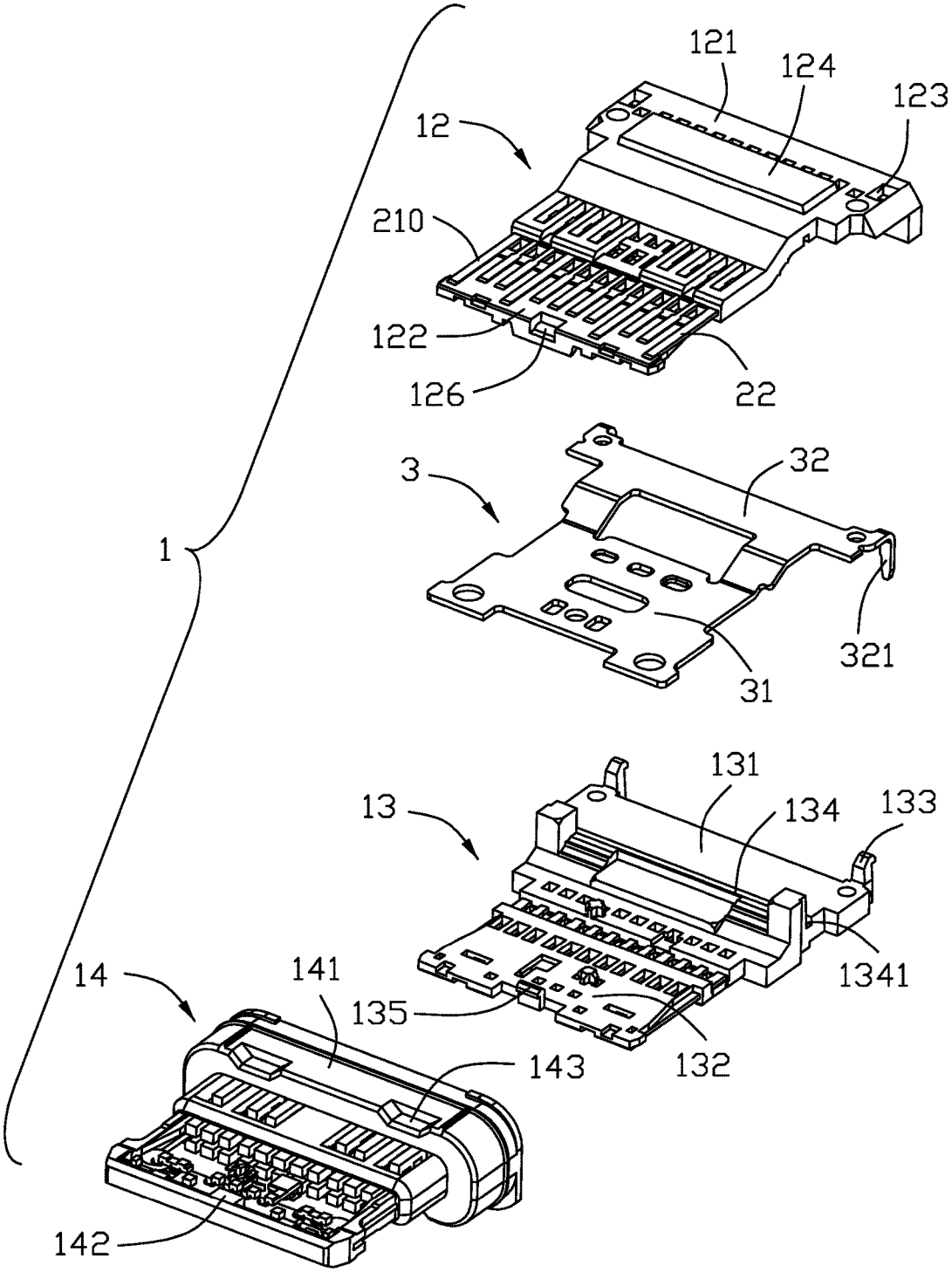
FIG. 9 is an exploded view of the contact module of the electrical connector in the first embodiment.
Figure 10:
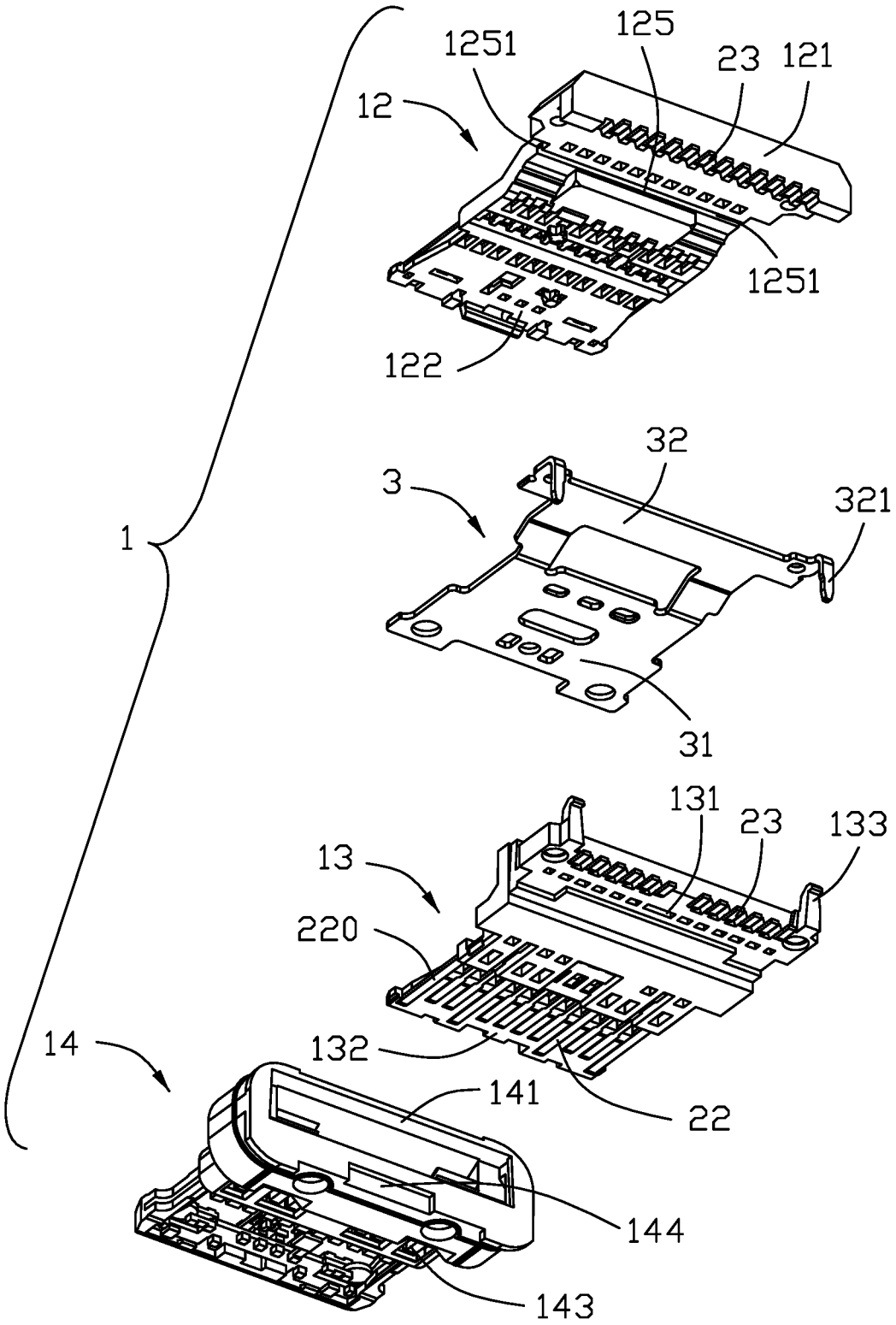
FIG. 10 is another exploded view of the contact module taken from FIG. 9.
Figure 11:
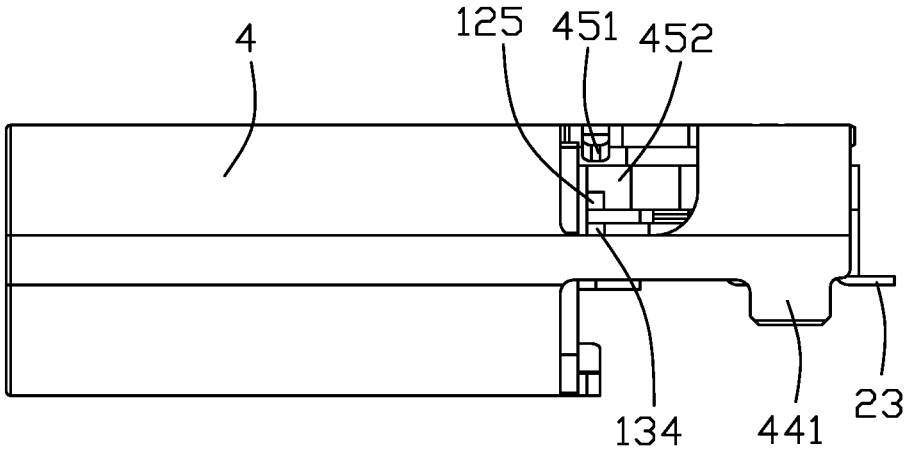
FIG. 11 is a lateral view of the electrical connector removing an insulative shell in the first embodiment.
Figure 12:
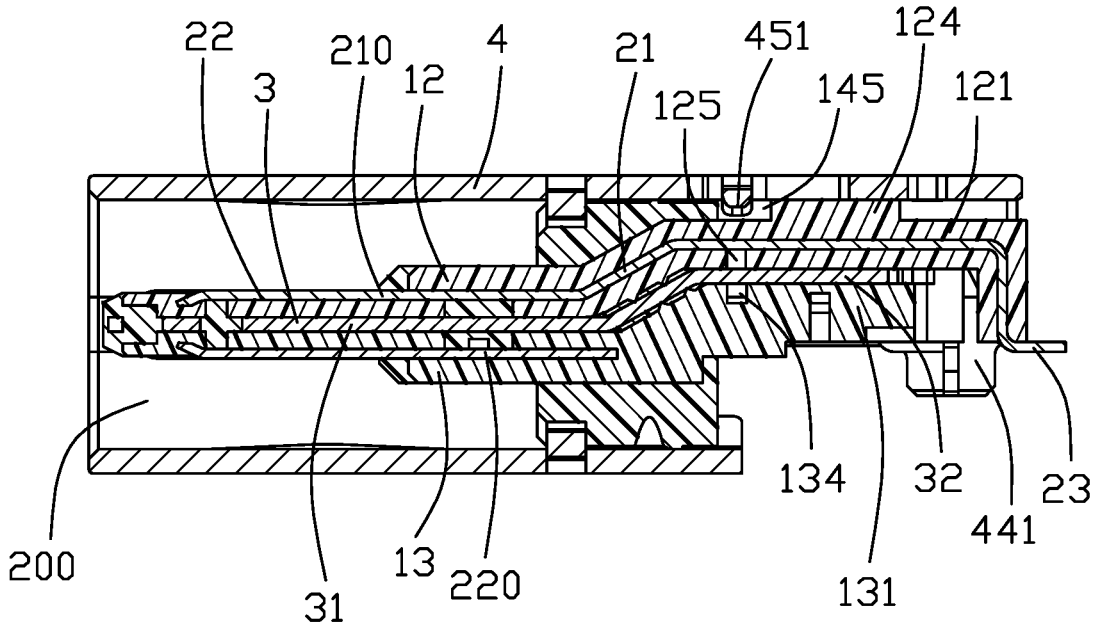
FIG. 12 is a cross-sectional view of the electrical connector taken along line 12-12 in FIG. 3 in the first embodiment.
Figure 13:
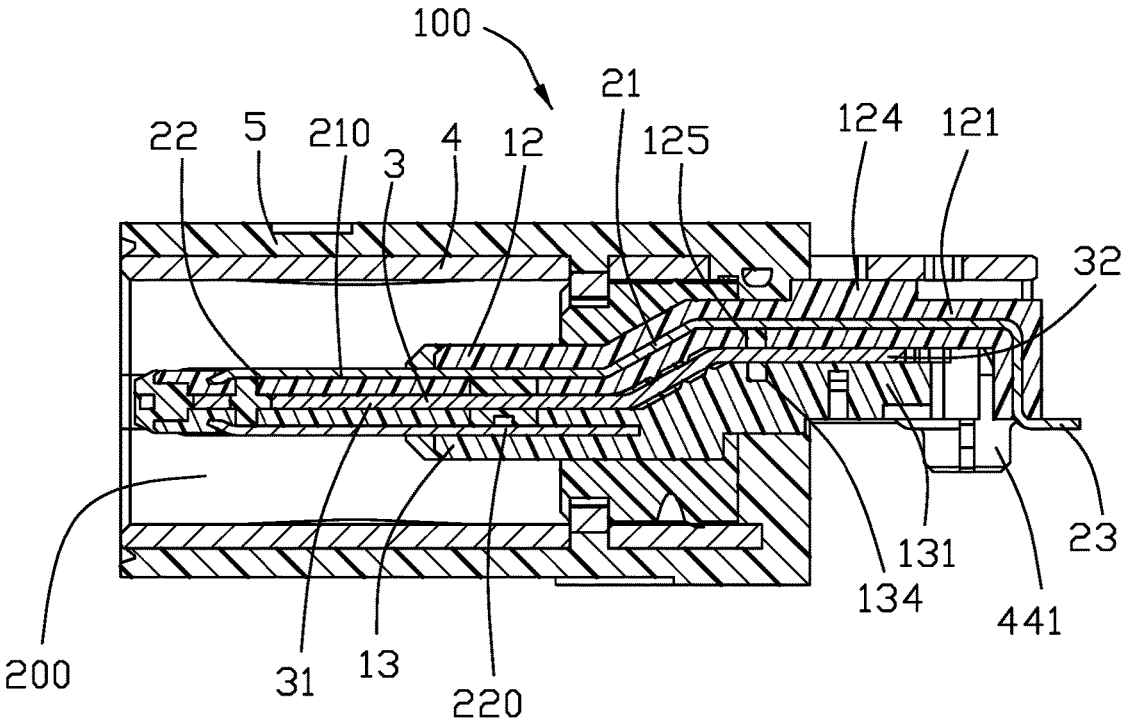
FIG. 13 is a cross-sectional view of the electrical connector taken along line 13-13 in FIG. 1 in the first embodiment.

Referring to FIGS. 9 to 10, the shielding plate 3 includes a front plate 31 and a rear plate 32 connecting with the front plate 31. The rear plate 32 includes a pair of soldering pins 321 extending downwardly from a pair of lateral sides thereof.

Referring to FIGS. 1-6 and 11-13, the shielding shell 4 includes a receiving room 200 for receiving the insulative housing 11. The shielding shell 4 includes a top wall 41, a bottom wall 42 opposite to the top wall 41, a pair of lateral walls 43 connecting the top wall 41 and the bottom wall 42, a tail 44 located at a rear end thereof and a connecting portion 45 connecting the top wall 41 and the tail 44 and located at the rear end. The top wall 41 and the bottom wall 42 include a pair of resisting portions 410 stamped stainless and extending into the receiving room 200 respectively. The bottom wall 42 includes a rear barrier 421 bending upwardly into the receiving room 200 from a rear end of the bottom wall 42. The length of the connecting portion 45 is small than that of the tail in the transverse direction. The connecting portion 45 includes a pair of openings located laterally and a location portion 452 bending inward at each opening 452. The tail 44 includes a pair of fixing pins 441 bending downwardly and located laterally. The lateral walls 43 include a pair of extending portions 431 extending rearward and connecting with the fixing pins 441.

The insulative shell 5 is insert-molded from plastic materials and has a mounting space 300 formed therein. The insulative shell 5 includes an upper insulative portion 51, a lower insulative portion 52 and a pair of lateral insulative portions 53 connecting the upper insulative portion 51 and the lower insulative portion 52. The lateral insulative portions 53 include a pair of ears 531 extending laterally.

The method of making the electrical connector 100 includes the following steps. Firstly provide the contact module 1. The contact module 1 includes the insulative housing 11, the upper terminals 210, the lower terminals 220 and the shielding plate 3. Provide insulative materials. The insulative materials are integrally insert-molded with the upper terminals 210 to form the first insulator 12. The fixed portion 21 of each upper terminal is affixed to the first insulator 12. The contacting portion 22 of each upper terminal is exposed to an upper surface of the first insulator 12. The soldering portion 23 of each upper terminal 210 extends outwardly from a rear end of the first insulator 12. The insulative materials are integrally insert-molded with the lower terminals 220 to form the second insulator 13. The fixed portion 21 of each lower terminal is affixed to the second insulator 13. The contacting portion 22 of each lower terminal is exposed to a lower surface of the second insulator 13. The soldering portion 23 of each lower terminal 220 extends outwardly from a rear end of the second insulator 13. Sandwich the shielding plate 3 between the first insulator 12 and the second insulator 13. The second locking portions 133 are mated with the first locking portions 123. The buckling tuber 135 is locked in the buckling hole 126. The front plate 31 is sandwiched between the first tongue portion 122 and the second tongue portion 132. The rear plate 32 is sandwiched between the first base portion 121 and the second base portion 131. The first groove 125 is aligned with the second groove 134 or not aligned with each other. Provide the third insulator 14. The third insulator 14 is insert-molded with the first insulator 12 and the second insulator 13 for forming the contact module 1. The soldering pins extend outwardly from a rear end of the insulative housing 11. There exists a gap 145 between a rear surface of the third base portion 141 and the protruding portion 124 of the second insulator 12. The rear surface of the third base portion 141 is in front of the first groove 125 and the second groove 134.

In a second step, provide the shielding shell 4. The shielding shell 4 encloses the contact module 1 making the contact module 1 received in the receiving room 200. The resisting portions 410 resist against the resisting recesses 143 avoiding the contact module 1 moving forwardly. The rear barriers 421 are locked in the buckling groove 144 avoiding the contact module 1 moving rearward. The location portion 451 is received in the gap 145. The opening 452 includes an overlapping part with the first groove 125 and the second groove 134 in the lengthwise direction perpendicular to the transverse direction.

In a third step, the insulative shell 5, which is insert-molded from insulative materials, is formed on an outer surface of the shielding shell 4 affixed with the terminal module 1. The insulative materials are filled in the gap 145 through the opening 452 making the location portion 451 affixed to the gap 145. The insulative materials flow through the first guiding openings 1251 and the second guiding openings 1341 making the first groove 125 and the second groove 134 filled with insulative materials.

Figure 14:
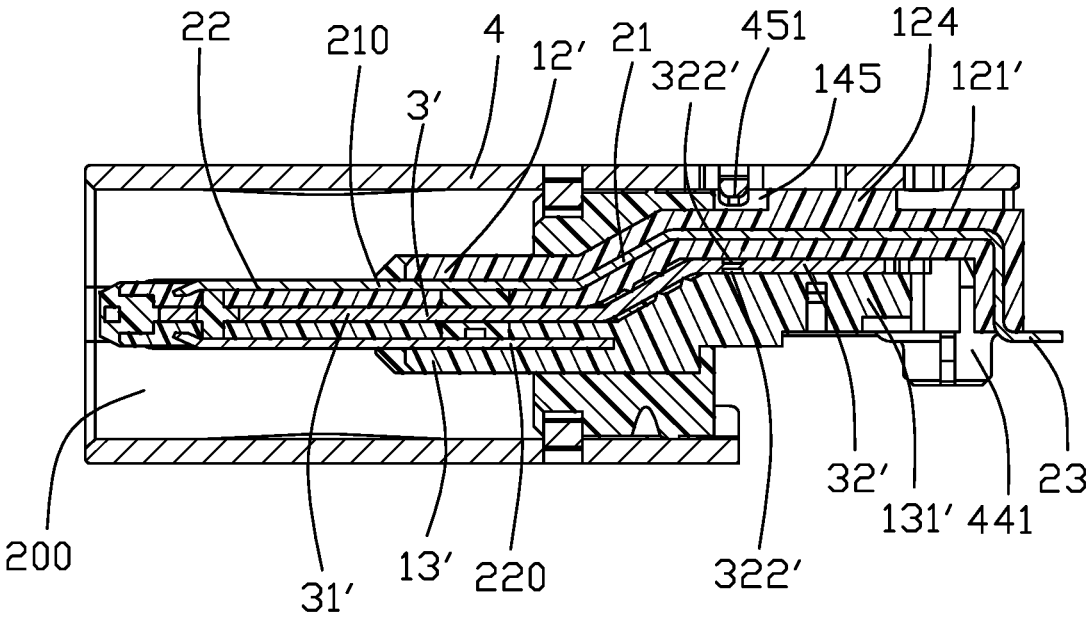
FIG. 14 is a cross-sectional view of the electrical connector in a second embodiment.

The second embodiment is showed in the FIG. 14. The difference between the first embodiment and the second embodiment is as followings. The shielding plate 3' includes a front plate 31' and a rear plate 32' connecting with the front plate 31'. The shielding plate 31' includes a third groove 322' located at the surfaces of the shielding plate 31' instead of the first insulator 12' and the second insulator 13'. The third groove 322" has a through hole (not labeled) communicating a left surface and a right surface thereof. The third groove 322' includes a pair of guiding openings (not shown) located laterally for guiding the insulative materials. The insulative materials fill in the third groove 322' through the guiding opening.

Figure 15:
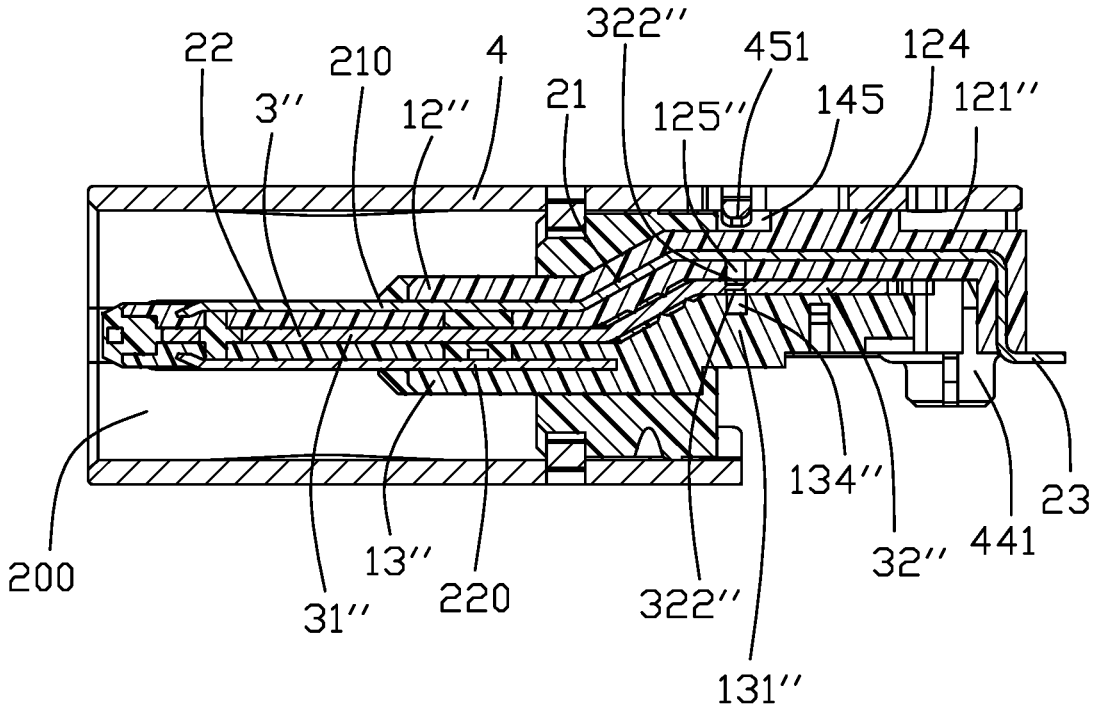
FIG. 15 is a cross-sectional view of the electrical connector in a third embodiment.

The third embodiment is shown in FIG. 15. The difference between the third embodiment and the first and second embodiment is as followings. The shielding plate 3" includes a front plate 31" and a rear plate 32". The first insulator 12" includes the first groove 125" located at a lower surface of the first base portion 121". The first groove 125" has a through hole (not labeled) communicating a left surface and a right surface thereof. The second insulator 13" includes the second groove 134" located at an upper surface of the second base portion 131". The second groove 134" has a through hole (not labeled) communicating a left surface and a right surface thereof. The shielding plate 3" includes a third groove 322" located at an upper surface and a lower surface of the rear plate 32". The third groove 322" has a through hole (not labeled) communicating a left surface and a right surface thereof. The first groove 125", the second groove 134", and the third groove 322" are aligned and communicated with each other in a vertical direction perpendicular to the transverse direction and the lengthwise direction. The first groove 125", the second groove 134", and the third groove 322" include a pair of guiding openings (not shown) respectively. The insulative materials are filled in the first groove 125", the second groove 134", and the third groove 322" through the guiding openings. The first groove 125", the second groove 134", and the third groove 322" are not aligned in the vertical direction making a not-so-well waterproof effect.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a contact module comprising an insulative housing having a first insulator and a second insulator assembled to the first insulator, and a shielding plate sandwiched between the first insulator and the second insulator;

a shielding shell enclosing the contact module; and an insulative shell insert-molded with the shielding shell; wherein each of the first insulator and the second insulator has a surface resisting a corresponding one of two surfaces of the shielding plate and at least one of the surface of the first insulator, the two surfaces of the shielding plate, and the surface of the second insulator comprises a groove recessed to receive insulative materials of the insulative shell along a transverse direction; and the groove has a plurality of guiding openings located laterally, and the groove is filled with the insulative materials through the guiding openings.

2. The electrical connector as claimed in claim 1, wherein the first insulator comprises a first base portion and a first tongue portion extending forwardly from the first base portion, the second insulator comprises a second base portion and a second tongue portion extending forwardly from the second base portion, a lower surface of the first base portion resists against the shielding plate, an upper surface of the second base portion resists against the shielding plate, and each of the lower surface of the first insulator and the upper surface of the second insulator has a respective groove aligned in a vertical direction perpendicular to the transverse direction.

3. The electrical connector as claimed in claim 1, wherein an upper surface and a lower surface of the shielding plate each have a respective groove.

4. The electrical connector as claimed in claim 1, wherein the first insulator comprises a first base portion and a first tongue portion extending forwardly from the first base portion, the second insulator comprises a second base portion and a second tongue portion extending forwardly from the second base portion, the shielding plate comprises a front plate corresponding with the first tongue portion and the second tongue portion, and a rear plate corresponding with the first base portion and the second base portion, and the first base portion, the second base portion, and the rear plate are each respectively provided with a groove aligned in a vertical direction perpendicular to the transverse direction.

5. The electrical connector as claimed in claim 1, wherein the insulative materials are insert-molded with the shielding shell to form the insulative shell.

6. The electrical connector as claimed in claim 1, wherein the insulative housing comprises a third insulator insert-molded with the first insulator and the second insulator, the third insulator comprises a third base portion, and a rear surface of the third base portion is in front of the groove.

7. The electrical connector as claimed in claim 6, wherein the shielding shell comprises an opening, and the opening has an overlapping part with the groove in a lengthwise direction perpendicular to the transverse direction.

8. The electrical connector as claimed in claim 1, wherein the insulative housing comprises a third insulator comprising a third base portion, the first insulator comprises a protruding portion, and there exists a gap between the protruding portion and a rear surface of the third base portion.

9. The electrical connector as claimed in claim 8, wherein the shielding shell comprises an opening and a location portion bent inward and located at the opening, and the insulative materials fill in the gap to make the location portion fill in the gap when the insulative shell is insert-molded with the shielding shell.

10. An electrical connector comprising:

a contact module comprising an insulative housing having a first insulator and a second insulator assembled to the first insulator, and a shielding plate sandwiched between the first insulator and the second insulator;

a shielding shell enclosing the contact module; and an insulative shell insert-molded with the shielding shell; wherein each of the first insulator and the second insulator has a surface resisting a corresponding one of two surfaces of the shielding plate and at least one of the surface of the first insulator, the two surfaces of the shielding plate, and the surface of the second insulator comprises a groove recessed to receive insulative materials of the insulative shell along a transverse direction;

the insulative housing comprises a third insulator insert-molded with the first insulator and the second insulator, the third insulator comprises a third base portion, and a rear surface of the third base portion is in front of the groove; and the shielding shell comprises an opening, and the opening has an overlapping part with the groove in a lengthwise direction perpendicular to the transverse direction.

11. The electrical connector as claimed in claim 10, wherein the first insulator comprises a first base portion and a first tongue portion extending forwardly from the first base portion, the second insulator comprises a second base portion and a second tongue portion extending forwardly from the second base portion, a lower surface of the first base portion resists against the shielding plate, an upper surface of the second base portion resists against the shielding plate, and each of the lower surface of the first insulator and the upper surface of the second insulator has a respective groove aligned in a vertical direction perpendicular to the transverse direction.

12. The electrical connector as claimed in claim 10, wherein an upper surface and a lower surface of the shielding plate each have a respective groove.

13. The electrical connector as claimed in claim 10, wherein the first insulator comprises a first base portion and a first tongue portion extending forwardly from the first base portion, the second insulator comprises a second base portion and a second tongue portion extending forwardly from the second base portion, the shielding plate comprises a front plate corresponding with the first tongue portion and the second tongue portion, and a rear plate corresponding with the first base portion and the second base portion, and the first base portion, the second base portion, and the rear plate are each respectively provided with a groove aligned in a vertical direction perpendicular to the transverse direction.

14. An electrical connector comprising:

a contact module comprising an insulative housing having a first insulator and a second insulator assembled to the first insulator, and a shielding plate sandwiched between the first insulator and the second insulator;

a shielding shell enclosing the contact module; and an insulative shell insert-molded with the shielding shell; wherein each of the first insulator and the second insulator has a surface resisting a corresponding one of two surfaces of the shielding plate and at least one of the surface of the first insulator, the two surfaces of the shielding plate, and the surface of the second insulator comprises a groove recessed to receive insulative materials of the insulative shell along a transverse direction; and the insulative housing comprises a third insulator comprising a third base portion, the first insulator comprises a protruding portion, and there exists a gap between the protruding portion and a rear surface of the third base portion.

15. The electrical connector as claimed in claim 14, wherein the first insulator comprises a first base portion and a first tongue portion extending forwardly from the first base portion, the second insulator comprises a second base portion and a second tongue portion extending forwardly from the second base portion, a lower surface of the first base portion resists against the shielding plate, an upper surface of the second base portion resists against the shielding plate, and each of the lower surface of the first insulator and the upper surface of the second insulator has a respective groove aligned in a vertical direction perpendicular to the transverse direction.

16. The electrical connector as claimed in claim 14, wherein an upper surface and a lower surface of the shielding plate each have a respective groove.

17. The electrical connector as claimed in claim 14, wherein the first insulator comprises a first base portion and a first tongue portion extending forwardly from the first base portion, the second insulator comprises a second base portion and a second tongue portion extending forwardly from the second base portion, the shielding plate comprises a front plate corresponding with the first tongue portion and the second tongue portion, and a rear plate corresponding with the first base portion and the second base portion, and the first base portion, the second base portion, and the rear plate are each respectively provided with a groove aligned in a vertical direction perpendicular to the transverse direction.

18. The electrical connector as claimed in claim 14, wherein the shielding shell comprises an opening and a location portion bent inward and located at the opening, and the insulative materials fill in the gap to make the location portion fill in the gap during insert-molding the insulative shell with the shielding shell.

* * * * *